US006624735B2

(12) United States Patent
Iida et al.

(10) Patent No.: US 6,624,735 B2
(45) Date of Patent: Sep. 23, 2003

(54) THREE-TERMINAL VARIABLE INDUCTOR AND METHOD OF MAKING THE SAME

(75) Inventors: Naoki Iida, Sabae (JP); Masahiko Kawaguchi, Takefu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/223,628

(22) Filed: Aug. 20, 2002

(65) Prior Publication Data

US 2002/0190833 A1 Dec. 19, 2002

Related U.S. Application Data

(62) Division of application No. 09/828,078, filed on Apr. 6, 2001, now Pat. No. 6,498,556.

(30) Foreign Application Priority Data

Apr. 6, 2000 (JP) ..... 2000-104791

(51) Int. Cl.[7] ..... H01F 5/00
(52) U.S. Cl. ..... 336/200; 29/602.1; 336/232
(58) Field of Search ..... 336/83, 200, 223, 336/232, 192; 29/602.1, 606, 609; 257/531

(56) References Cited

U.S. PATENT DOCUMENTS

| | | | | |
|---|---|---|---|---|
| 6,114,938 A | * | 9/2000 | Iida et al. | 336/200 |
| 6,329,715 B1 | * | 12/2001 | Hayashi | 257/531 |
| 6,369,683 B1 | * | 4/2002 | Iida et al. | 336/200 |
| 6,369,684 B1 | * | 4/2002 | Iida et al. | 336/200 |
| 6,404,319 B1 | * | 6/2002 | Iida et al. | 336/200 |

FOREIGN PATENT DOCUMENTS

| | | |
|---|---|---|
| JP | 50-020156 | 6/1973 |
| JP | 4-131908 | 12/1992 |
| JP | 8-306533 A | 11/1996 |
| JP | 11-144964 A | 5/1999 |

* cited by examiner

*Primary Examiner*—Tuyen T. Nguyen
(74) *Attorney, Agent, or Firm*—Keating & Bennett, LLP

(57) ABSTRACT

In a three-terminal variable inductor, a pair of spiral coil electrodes and a plurality of trimming electrodes are disposed on an insulative substrate. The trimming electrodes are arranged so as to bridge the respective outer portions of the spiral coil electrodes without crossing any of the spiral coil electrodes, thus electrically connecting the spiral coil electrodes. Laser beams are irradiated onto the trimming electrodes, so that a groove is formed so as to cut the trimming electrodes one by one, whereby inductance is changed as desired.

11 Claims, 5 Drawing Sheets

THREE-TERMINAL VARIABLE INDUCTOR AND METHOD OF MAKING THE SAME

This is a Divisional of U.S. patent application Ser. No. 09/828,078 filed Apr. 6, 2001, now U.S. Pat. No. 6,498,556.

BACKGROUND OF THE INVENTION

1. Field of the Invention

The present invention generally relates to three-terminal variable inductors, and more particularly, to a three-terminal inductor for use in, for example, mobile communication devices.

2. Description of the Related Art

It is becoming more and more critical that current electronic devices have smaller sizes, and especially for mobile communication devices such as cellular phones and automobile phones, components incorporated therein must be severely restricted in size. In addition, as the operating frequency becomes higher, the circuit and components defining circuits in such devices become more complex, and the components tolerate less variations. Conventionally, in manufacturing a circuit having a center tap connected to the electric center of a coil, a pair of coil components 101 and 102 are mounted on a printed circuit board 106, and are electrically connected to each other via electrodes 103 and 104 and a center tap electrode 105 provided on the printed circuit board 106, as shown in FIG. 9. As methods of changing the values of inductance of the coil components 101 and 102, it has been proposed, for example, that the coil components 101 and 102 be replaced by other two coil components having different values of inductance which are balanced in advance, or variable coils be used as the coil components 101 and 102 and the values of inductance thereof be changed while maintaining the balance of the inductance values.

In accordance with these methods, however, due to component variations or displacements during mounting, the inductance values of the coil components 101 and 102 may not be well balanced. It may also occur that the center tap electrode is connected off the electric center of the coil defined by the coil components 101 and 102. In addition, because the two coil components 101 and 102 are electrically connected via the center tap electrode 105 provided on the printed circuit board 106, a considerable area is occupied on the printed circuit board 106.

Furthermore, as for the method which changes the inductance values by replacing the coil components 101 and 102 with other two coil components, the complex work of removing the coil components has inhibited automation and mass production. Similarly, as for the method which uses variable coils as the coil components 101 and 102 to change the inductance values of the coil components 101 and 102, the complex work of adjusting the inductance values while maintaining the balance therebetween has also inhibited automation and mass production.

In order to overcome these problems, a three-terminal variable inductor 110 shown in FIG. 10 has been proposed. In the three-terminal variable inductor 110, a pair of spiral coil electrodes 112 and 113 having identical dimensions are disposed on the top surface of an insulative substrate 111. The spiral coil electrodes 112 and 113 are electrically connected to trimming electrodes 116*a* to 116*d* via openings provided on an insulating protective film 115. The trimming electrodes 116*a* to 116*d* are connected to a center tap electrode 117, thereby being electrically connected to a common terminal electrode 122. One end of the coil electrode 112 and one end of the coil electrode 113 are electrically connected to a terminal electrode 120 and a terminal electrode 121, respectively.

In order to adjust the value of inductance of the three-terminal variable inductor 110, the trimming electrodes 116*a* to 116*d* are cut one by one as desired, for example, by irradiating laser beams on the three-terminal variable inductor 110. Accordingly, the value of inductance between the terminal electrode 120 and the common terminal electrode 122 and the value of inductance between the terminal electrode 121 and the common terminal electrode 122 can be changed in steps while maintaining the balance therebetween.

In the three-terminal variable inductor 110, however, because the trimming electrodes 116*a* to 116*d* are arranged to partially overlap the spiral coil electrodes 112 and 113, stray capacitance between the trimming electrodes 116*a* to 116*d* and the spiral coil electrodes 112 and 113 is large. Therefore, the three-terminal variable inductor 110 has a low self resonance frequency and fails to provide favorable frequency characteristics at higher frequencies. In addition, the trimming electrodes 116*a* to 116*d* shield magnetic fields generated by the spiral coil electrodes 112 and 113, resulting in inadequate Q characteristics of the three-terminal variable inductor 110.

SUMMARY OF THE INVENTION

In order to solve the problems described above, preferred embodiments of the present invention provide a three-terminal variable inductor which is very small, minimizes the occupied area on a printed circuit board when mounted thereon, achieves stable adjustment of inductance values while maintaining a good balance, and which achieves excellent characteristics.

According to a preferred embodiment of the present invention, a three-terminal variable inductor includes a first terminal electrode, a second terminal electrode, a third terminal electrode, a first spiral coil electrode electrically connected between the first terminal electrode and the third terminal electrode, an inner end portion thereof being associated with the first terminal electrode and an outer portion thereof being associated with the third terminal electrode, a second spiral coil electrode electrically connected between the second terminal electrode and the third terminal electrode, an inner end portion thereof being associated with the second terminal electrode and an outer portion thereof being associated with the third terminal electrode, and at least one trimming electrode arranged so as not to cross any portion of the first spiral coil electrode and the second spiral coil electrode, between the outer portion of the first spiral coil electrode and the outer portion of the second spiral coil electrode, the outer portions being disposed in proximity to each other, the at least one trimming electrode electrically connecting the first spiral coil electrode and the second spiral coil electrode.

In accordance with the unique construction of the preferred embodiment of the present invention described above, by trimming the at least one trimming electrode, the value of inductance between the first terminal electrode and the second terminal electrode can be changed without disturbing the balance of the inductance value between the first terminal electrode and the third terminal electrode and the inductance value between the second terminal electrode and the third terminal electrode. In addition, since the trimming electrode is arranged so as not to cross any portion of the first spiral coil electrode and the second spiral coil electrode, the three-terminal variable inductor has a small stray capacitance between the trimming electrode and the first and second spiral coil electrodes and therefore has a high self resonance frequency, thus exhibiting favorable frequency characteristics at high frequency bands. Furthermore, since the trimming electrode does not block magnetic fields generated by the first and the second spiral coil electrodes, Q characteristics are greatly improved.

The three-terminal variable inductor may further include a plurality of trimming electrodes, and a center tap electrode electrically connected to the third terminal electrode is disposed between the outer portion of the first spiral coil electrode and the outer portion of the second spiral coil electrode, the outer portions being disposed in proximity to each other, the plurality of trimming electrodes being electrically connected to the center tap electrode.

In accordance with the above-described unique construction, by trimming the at least one trimming electrode, the value of inductance between the first and second terminal electrodes, the value of inductance between the first and third terminal electrodes, and the value of inductance between the second and third terminal electrodes can be changed without disturbing the balance of the value of inductance between the first and third terminal electrodes and the value of inductance between the second and third terminal electrodes.

The first terminal electrode, the second terminal electrode, the third terminal electrode, the first spiral coil electrode, the second spiral coil electrode, and the at least one trimming electrode may be disposed on the surface of an insulative substrate of a chip component.

Alternatively, the first terminal electrode, the second terminal electrode, the third terminal electrode, the first spiral coil electrode, the second spiral coil electrode, and the at least one trimming electrode may be disposed on the surface of a circuit board provided with a circuit pattern.

In accordance with either of the above unique constructions according to preferred embodiments of the present invention, the at least one trimming electrode and the first and the second spiral coil electrodes are disposed on a single layer, so that the number of interlayer connections is reduced, thereby the inductance component having a high reliability of the connections between layers is obtained.

Furthermore, because the trimming electrode is connected to the outermost portions of the first and the second spiral coil electrodes, the electrodes can be arranged to be substantially parallel to each other efficiently using the region in the longitudinal direction of the insulative substrate. Thus, the trimming electrodes can be disposed in an extended area, and therefore, the variable range of inductance value can be increased by approximately 10% compared with conventional variable inductors. In addition, the first and second spiral coil electrodes can also be disposed in a larger area, achieving an improvement of approximately 5% in the maximum obtainable inductance value.

Other features, elements, characteristics and advantages of the present invention will become apparent from the detailed description of preferred embodiments with reference to the attached drawings.

DETAILED DESCRIPTION OF PREFERRED EMBODIMENTS

A three-terminal variable inductor according to a preferred embodiment of the present invention, and a method of manufacturing the same, will be described below with reference to the accompanying drawings.

Figure 1:
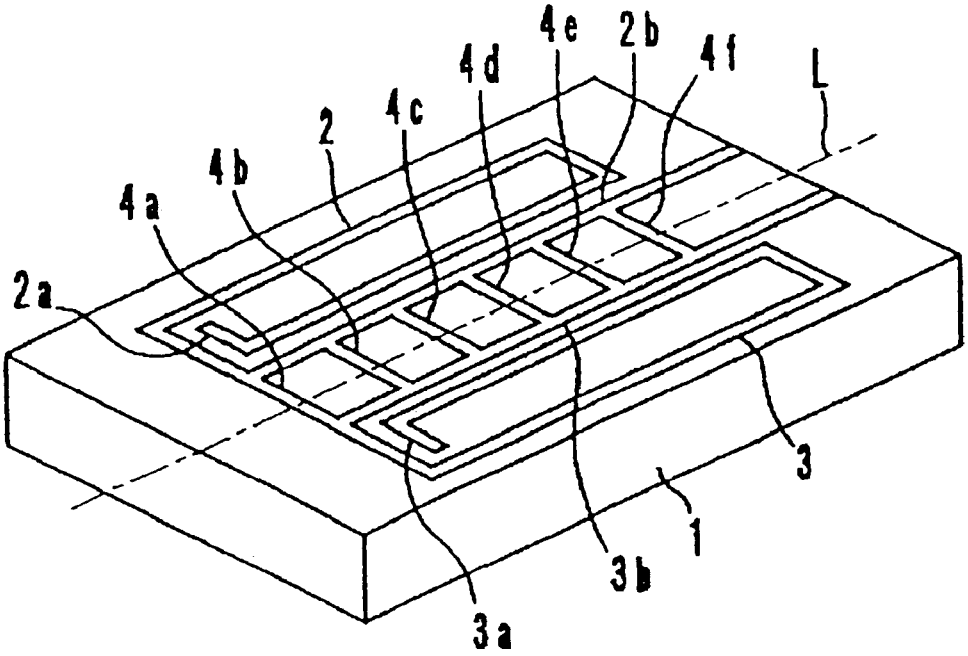
FIG. 1 is a perspective view of a three-terminal variable inductor according to a preferred embodiment of the present invention while being manufactured.

Referring first to FIG. 1, the top surface of an insulative substrate 1 is polished to achieve smoothness. Then, spiral coil electrodes 2 and 3 and trimming electrodes 4*a* to 4*f* are formed on the top surface of the insulative substrate 1, for example, by a thick-film printing method or a thin-film forming method such as sputtering and vapor deposition, or other suitable method. In thick-film printing, by way of example, a stencil having a predetermined pattern of openings is placed on the top surface of the insulative substrate 1, and conductive paste is applied over the stencil, so that a desired pattern of relatively-thick conductors, i.e., the spiral coil electrodes 2 and 3 and the trimming electrodes 4*a* to 4*f* in this preferred embodiment, are formed on the top surface of the insulative substrate 1 which is exposed via the openings of the stencil.

In thin-film forming, a relatively-thin conductive film is formed substantially over the entire top surface of the insulative substrate 1, for example, by sputtering. Then, a resist film, for example, a photosensitive resin film, is formed substantially over the entire surface of the conductive film, for example, by spin coating or printing. Then, a masking film having a predetermined image pattern formed thereon is placed on the top surface of the resist film, and the desired regions of the resist film are cured by, for example, exposing to ultraviolet rays. Then, the uncured portions of the resist film are removed while leaving the cured portions thereof. Then the exposed portions of the conductive film are etched away, and thereafter, the cured portion of the resist film are also removed. Thus, a desired pattern of conductors, i.e., the spiral coil electrodes 2 and 3 and the trimming electrodes 4*a* to 4*f* in this preferred embodiment, is formed.

Alternatively, the conductor pattern may be formed by applying photosensitive conductive paste on the top surface of the insulative substrate 1, placing a mask film, having a predetermined image pattern formed thereon, over the photosensitive conductive paste, and exposing the mask film and thereby developing a corresponding image.

The spiral coil electrodes 2 and 3 are wound in mutually opposite directions, and are disposed on the front surface and on the back surface of the insulative substrate 1, respectively, as shown in FIG. 1. One end portion (inner portion) 2*a* of the spiral coil electrode 2 and one end portion (inner portion) 3*a* of the spiral coil electrode 3 are located on the inner surface of the respective spiral coil electrodes 2 and 3. The other end (outer portion) 2*b* of the spiral coil electrode 2 and the other end (outer portion) 3*b* of the spiral coil electrode 3 are located on the outer side of the respective spiral coil electrodes 2 and 3, and are arranged to be substantially parallel in proximity to each other at the approximate center of the insulative substrate 1. The respective edges of the ends 2*b* and 3*b* are exposed at the right end of the insulative substrate 1, as viewed in FIG. 1.

The trimming electrodes 4*a* to 4*f* are arranged in a ladder arrangement between the ends (outer portions) 2*b* and 3*b* of the spiral coil electrodes 2 and 3. That is, each of the trimming electrodes 4*a* to 4*f* bridges the ends (outer portions) 2*b* and 3*b* of the spiral coil electrodes 2 and 3 to electrically connect the spiral coil electrodes 2 and 3 without crossing any portion of the spiral coil electrodes 2 and 3. Each of the trimming electrodes 4*a* to 4*f* is in linear symmetry with each other, and the spiral coil electrodes 2 and 3 are disposed symmetrically to each other with respect to the axis L of the line symmetry. The spiral coil electrodes 2 and 3 are also arranged so that the inductance values thereof are substantially equal. The insulative substrate 1 is preferably composed of, for example, glass, glass ceramic, alumina, ferrite, Si, and $SiO_2$, or other suitable material. The spiral coil electrodes 2 and 3 and the trimming electrodes 4*a* to 4*f* are preferably composed of, for example, Ag, Ag—Pd, Cu, Au, Ni, and Al, or other suitable material.

Figure 2:
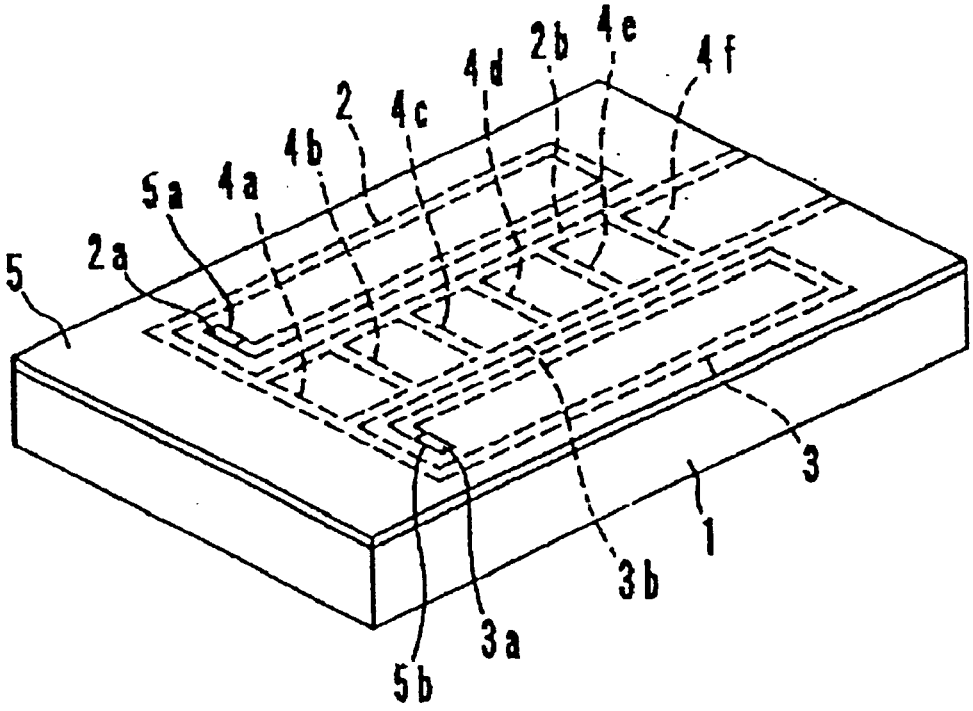
FIG. 2 is a perspective view of the three-terminal variable inductor in a subsequent manufacturing step.

Referring next to FIG. 2, an insulating protective film 5 having openings 5*a* and 5*b* is formed. More specifically, an insulating liquid material is applied substantially over the entire top surface of the insulative substrate 1, for example, by spin coating or printing, and then, the insulating liquid material is dried and fired to form an insulating protective film 5. The insulating material is preferably, for example, photosensitive polyimide resin or photosensitive glass paste. Then, a mask film having a predetermined image pattern is placed on the top surface of the insulating protective film 5, and desired portions of the insulating protective film 5 are cured, for example, by exposing them to ultraviolet rays. Then, the uncured portions of the insulating protective film 5 are removed to form the openings 5*a* and 5*b*. The inner portions 2*a* and 3*a* located inside of the spiral coil electrodes 2 and 3 are exposed through the openings 5*a* and 5*b*, respectively.

Figure 3:
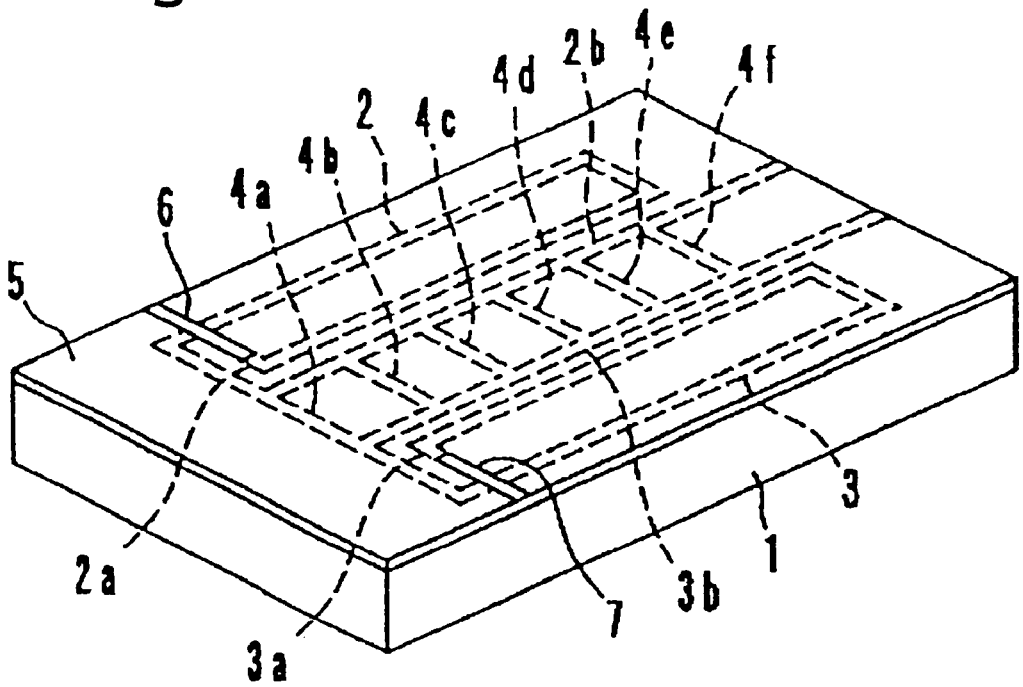
FIG. 3 is a perspective view of three-terminal variable inductor in a further subsequent manufacturing step.

Referring next to FIG. 3, lead electrodes 6 and 7 are preferably formed by thick-film printing or thin-film forming such as sputtering and vapor deposition, similarly to the case of the spiral coil electrodes 2 and 3. One end of the lead electrode 6 is electrically connected to the end (inner portion) 2*a* of the spiral coil electrode 2 via the opening 5*a* of the insulating protective film 5, and the other end thereof is exposed at the back end of the insulative substrate 1, as shown in FIG. 3. Similarly, one end of the lead electrode 7 is electrically connected to the end (inner portion) 3*a* of the spiral coil electrode 3 via the opening 5*b* of the insulating protective film 5, and the other end thereof is exposed at the front end of the insulative substrate 1, as shown in FIG. 3.

Figure 4:
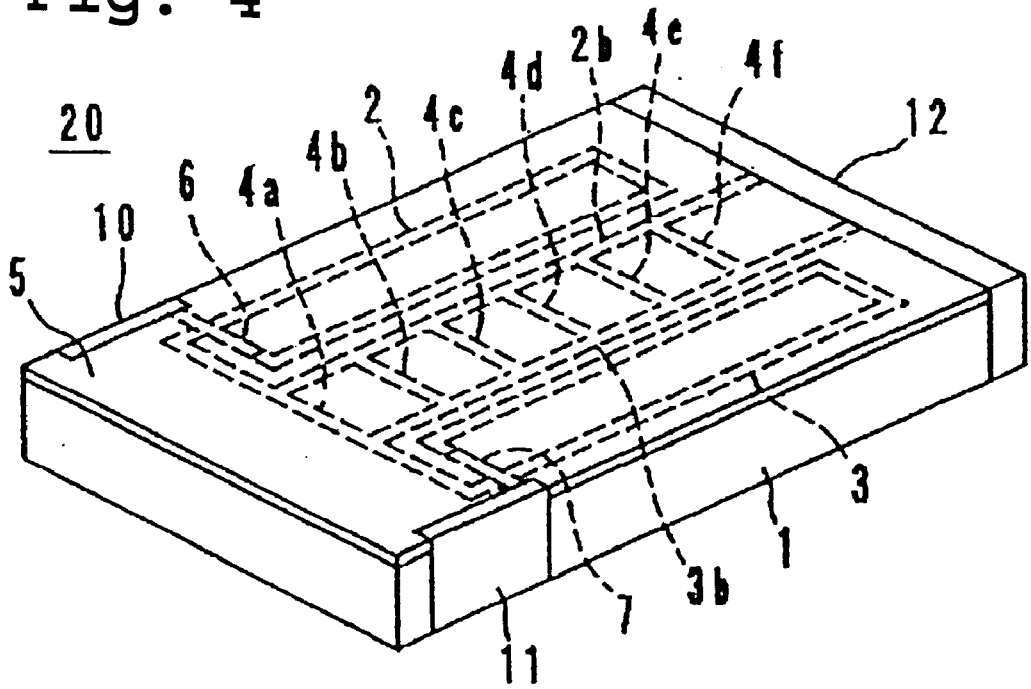
FIG. 4 is an external perspective view of the three-terminal variable inductor after manufacturing thereof is complete.

Referring next to FIG. 4, an insulating liquid material is applied over the entire top surface of the insulative substrate 1, for example, by spin coating or printing, and then, the insulating liquid material is dried and fired so that the insulating protective film 5 covers the lead electrodes 6 and 7. Then, terminal electrodes 10 and 11 are formed on the back and front ends of the insulative substrate 1, respectively, as shown in FIG. 4. The terminal electrode 10 is electrically connected to the end 2*a* of the spiral coil electrode 2 via the lead electrode 6, and the terminal electrode 11 is electrically connected to the end 3*a* of the spiral coil electrode 3 via the lead electrode 7. Furthermore, a common terminal electrode 12 is formed on the right end of the insulative substrate 1, as shown in FIG. 4. The common terminal electrode 12 is electrically connected to the ends 2*b* and 3*b* of the spiral coil electrodes 2 and 3. The terminal electrodes 10 and 11 and the common terminal electrode 12 are formed, for example, by applying and firing a conductive paste such as Ag, Ag—Pd, Cu, Ni, NiCr, and NiCu, or other suitable material and forming a metallic layer of Ni, Sn, Sn—Pb, or other suitable material thereon after firing by wet electro-plating, by sputtering, or by vapor deposition, or other suitable process.

Figure 5:
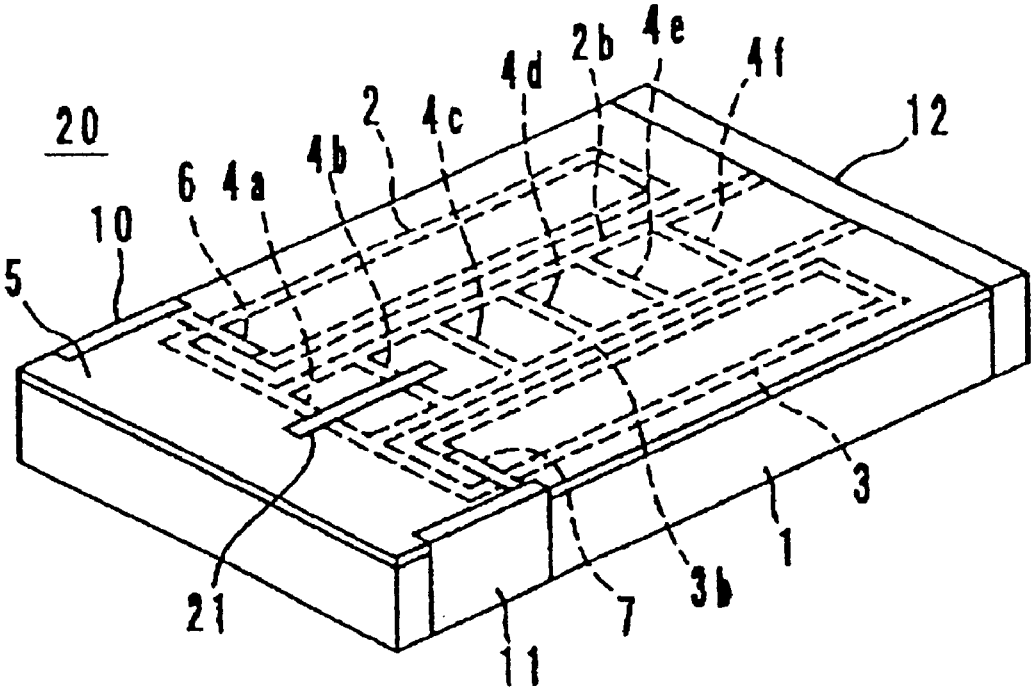
FIG. 5 is a perspective view that is helpful for explaining a method of adjusting inductance in the three-terminal variable inductor shown in FIG. 4.

A three-terminal variable inductor 20 thus manufactured is mounted, for example, on a printed wiring board, and then the trimming electrodes 4*a* to 4*f* are trimmed as desired. More specifically, a trimming groove 21 is formed on the three-terminal variable inductor 20, for example, by irradiating the top surface of the three-terminal variable inductor 20 with laser beams, thereby cutting as desired the trimming electrodes 4*a* to 4*f* one by one starting from the trimming electrode 4*a* located on one end. By way of example, FIG. 5 shows the two trimming electrodes 4*a* and 4*b* are cut. Thus, the value of inductance between the terminal electrode 10 and the terminal electrode 11 can be changed in a stepwise manner without changing the value of inductance between the terminal electrode 10 and the common terminal electrode 12, and the value of inductance between the terminal electrode 11 and the common terminal electrode 12.

Accordingly, in the three-terminal variable inductor 20, by disposing the trimming electrodes 4*a* to 4*f* at predetermined positions which allow the value of inductance between the terminal electrode 10 and the terminal electrode 11 to be changed by a desired amount, the value of inductance between the terminal electrode 10 and the terminal electrode 11 can be changed in a stepwise manner by the desired pitch without disturbing the balance of the value of inductance between the terminal electrode 10 and the common terminal electrode 12 and the value of inductance between the terminal electrode 11 and the common terminal electrode 12.

In addition, because the three-terminal variable inductor 20 incorporates the spiral coil electrodes 2 and 3, two individual coil components are not required to be provided on the printed wiring board and electrically connected via a circuit pattern thereon, thus saving area on the printed wiring board.

Figure 6:
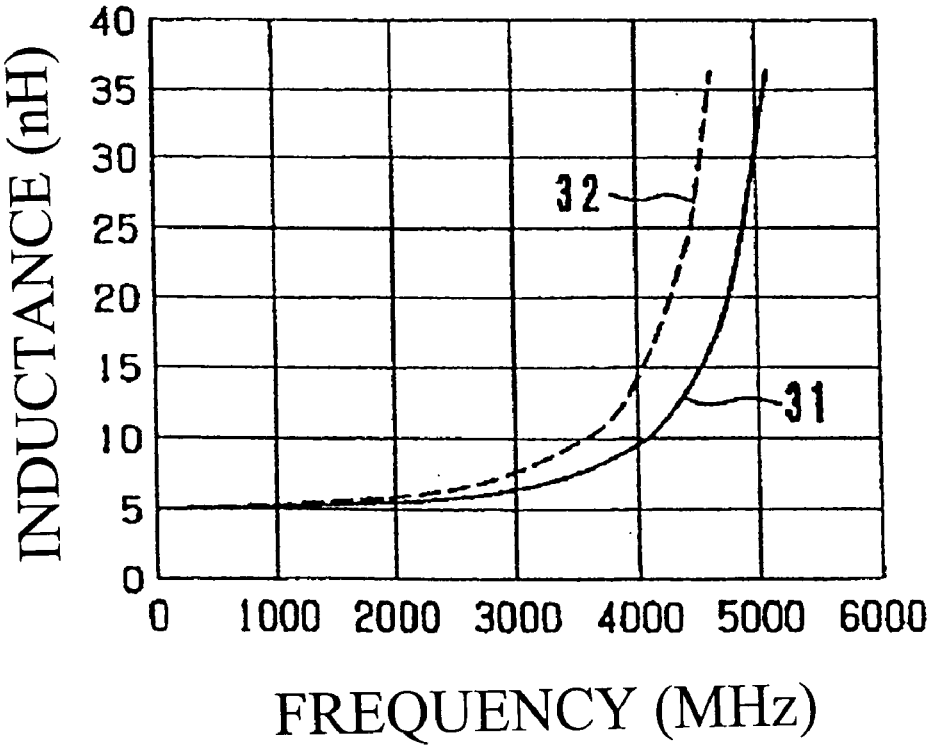
FIG. 6 is a graph showing the inductance-frequency characteristics of the three-terminal variable inductor shown in FIG. 4.

Furthermore, because the trimming electrodes 4*a* to 4*f* are disposed without crossing any of the spiral coil electrodes 2 and 3, i.e., without overlapping any of the spiral coil electrodes 2 and 3, stray capacitance between the trimming electrodes 4*a* to 4*f* and the spiral coil electrodes 2 and 3 is small. Therefore, the three-terminal variable inductor 20 has a high self resonance frequency, and thus the three-terminal variable inductor 20 is superior to the conventional inductors with respect to characteristics at high frequency bands. FIG. 6 is a graph showing the inductance-frequency characteristics of the three-terminal variable inductor 20, indicated by the solid line 31. For comparison, the inductance-frequency characteristics of the conventional inductor 110 are also shown, indicated by the dotted line 32. It is understood from FIG. 6 that the resonance frequency of the three-terminal variable inductor 20 is higher by approximately 10% than that of the conventional inductor 110.

Figure 7:
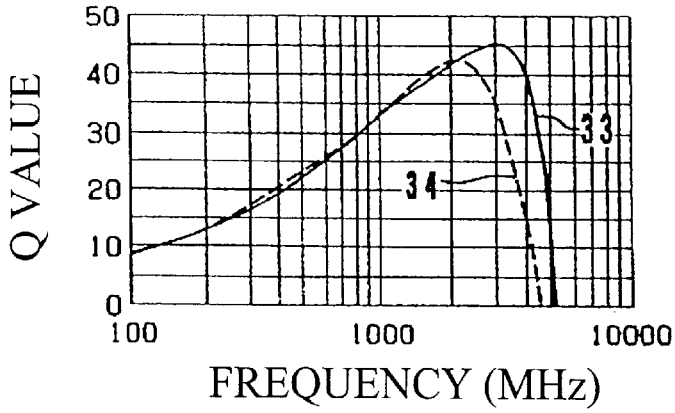
FIG. 7 is a graph showing the Q characteristics of the three-terminal variable inductor shown in FIG. 4.

In addition, the trimming electrodes 4*a* to 4*f* are disposed so as not to block magnetic fields generated by the spiral coil electrodes 2 and 3, so that the three-terminal variable inductor 20 exhibits excellent Q characteristics. FIG. 7 is a graph showing the Q characteristics of the three-terminal variable inductor 20, indicated by the solid line 33. For comparison, the Q characteristics of the conventional inductor 110 is also shown, indicated by the dotted line 34. It is understood from FIG. 7 that compared with the conventional inductor 110, the three-terminal variable inductor 20 exhibits greatly improved Q characteristics at higher frequencies, and the peak value is also increased by approximately 10%.

Furthermore, in accordance with the construction in which the trimming electrodes 4*a* to 4*f* are connected to the outermost portions of the spiral coil electrodes 2 and 3, the trimming electrodes 4*a* to 4*f* can be arranged substantially parallel to one another efficiently using the length of the insulating substrate 1. Thus, the trimming electrodes 4*a* to 4*f* can be disposed in an extended area, and therefore, the variable range of the inductance value can be increased by approximately 10% compared with conventional inductors. In addition, the spiral coil electrodes 2 and 3 can be disposed in a larger area, achieving an increase of approximately 5% in the maximum obtainable inductance value.

Figure 10:
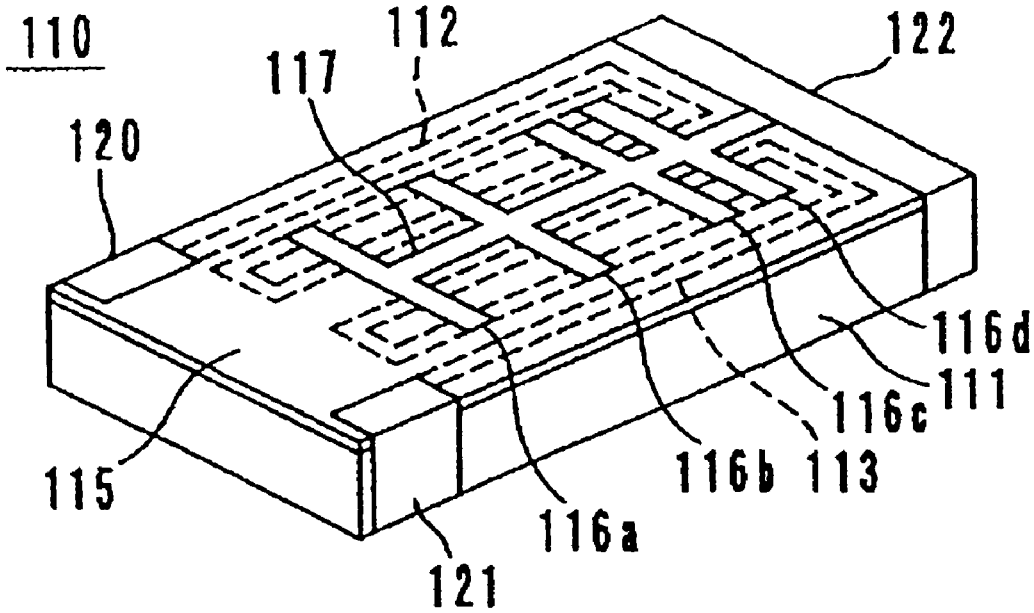
Fig. 10 PRIOR ART
FIG. 10 is a perspective view of another conventional variable inductor.

In the conventional inductor 110 shown in FIG. 10, the trimming electrodes 116*a* to 116*d* are electrically connected to the spiral coil electrodes 112 and 113 via openings provided on the insulating protective film 115. Thus, with an increase in the number of the trimming electrodes, the number of connections via the openings also increases, diminishing the reliability of interlayer connections. In contrast, in the three-terminal variable inductor 20 according to preferred embodiments of the present invention, interlayer connections are implemented at only two points, i.e., by connecting the spiral coil electrodes 2 and 3 and the lead electrodes 6 and 7, respectively, providing excellent reliability of the interlayer connections irrespective of the number of the trimming electrodes.

The trimming electrodes 4*a* to 4*f* may be trimmed using any method including sandblasting as well as laser beam cutting, and as long as the trimming electrodes 4*a* to 4*b* are electrically cut accurately, the trimming need not necessarily involve a physical concavity structure such as the trimming groove 21. If glass or glass ceramic is used as the material of the insulating protective film 5, the glass material is melted due to laser beams and then flows into trimmed areas, functioning as a protective film which prevents exposure of the trimming electrodes 4*a* to 4*f* after the trimming.

The present invention is not limited to the above-described preferred embodiments, and various modifications can be made within the scope of the present invention. For example, the three-terminal variable inductor 20 may be modified to have a center tap electrode 41 electrically connected to the common terminal electrode 12 and disposed between the end 2*b* of the spiral coil electrode 2 and the end 3*b* of the spiral coil electrode 3, as in a three-terminal variable inductor 40 shown in FIG. 8. The center tap electrode 41 is electrically connected to each of the trimming electrodes 4*a* to 4*f*.

Figure 8:
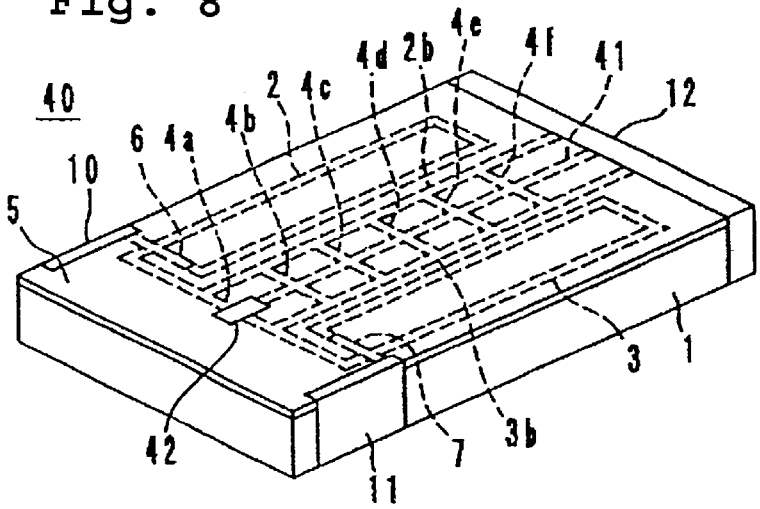
FIG. 8 is a perspective view of a three-terminal variable inductor according to a modification of the three-terminal variable inductor.
Figure 9:
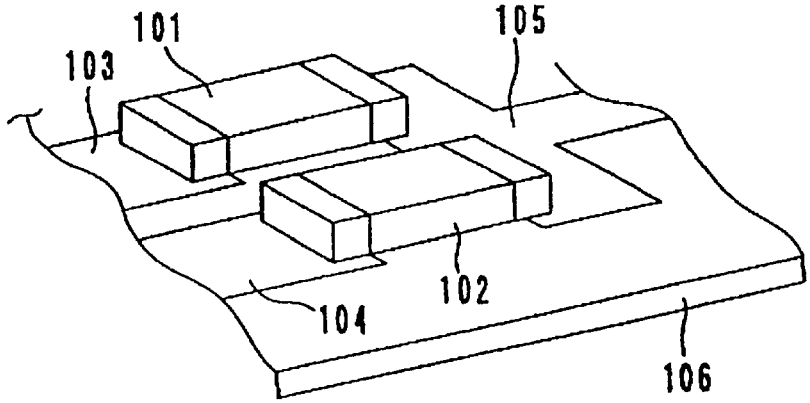
Fig. 9 PRIOR ART
FIG. 9 is a perspective view of a conventional variable inductor.

In order to trim the trimming electrodes 41a to 41f, for example, the center tap electrode 41 is irradiated with laser beams as desired so as to form a trimming groove 42 on the three-terminal variable inductor 40, thereby cutting the trimming electrodes 4*a* to 4*f* one by one as desired. FIG. 8 shows the trimming groove 42 cutting only the trimming electrode 4*a*. Accordingly, the value of inductance between the terminal electrode 10 and the terminal electrode 11, the value of inductance between the terminal electrode 10 and the common terminal electrode 12, and the value of inductance between the terminal electrode 11 and the common terminal electrode 12 can be changed in a stepwise manner without disturbing the balance of the value of inductance between the terminal electrode 10 and the common terminal electrode 12 and the value of inductance between the terminal electrode 11 and the common terminal electrode 12.

The spiral coil electrodes 2 and 3 need not necessarily be disposed symmetrically to each other with respect to the trimming electrodes 4*a* to 4*f*, and may have different shapes and different inductance values.

Furthermore, the inductor may be implemented by forming the spiral coil electrodes 2 and 3 and the trimming electrodes 4*a* to 4*f* directly on a printed circuit board provided with a circuit pattern.

Furthermore, although preferred embodiments have been described in the context of manufacturing the three-terminal variable inductor individually, in mass production, it is efficient to form a plurality of three-terminal variable inductors on a mother substrate (i.e., wafer), and cutting into individual products by, for example, dicing, scribe-breaking, or using laser beams.

While the present invention has been described with reference to preferred embodiments thereof, it will be understood by those skilled in the art that the foregoing and other changes in form and details can be made therein without departing from the spirit and scope of the invention.

What is claimed is:

1. A method of manufacturing a three-terminal variable inductor comprising the steps of:

providing a substrate;

forming first, second and third terminals on the substrate;

forming a first spiral coil electrode so as to be electrically connected between said first terminal electrode and said third terminal electrode;

forming a second spiral coil electrode so as to be electrically connected between said second terminal electrode and said third terminal electrode;

forming at least one trimming electrode so as not to cross any portion of said first spiral coil electrode and said second spiral coil electrode, between the outer portion of said first spiral coil electrode and the outer portion of said second spiral coil electrode, the outer portions being disposed in proximity to each other, said at least one trimming electrode electrically connecting said first spiral coil electrode and said second spiral coil electrode; and trimming said at least one trimming electrode.

2. The method according to claim 1, wherein the step of trimming the least one trimming electrode includes forming a trimming groove by irradiating the top surface of substrate including the first, second, and third terminal electrodes.

3. The method according to claim 2, wherein the step for forming the at least one trimming electrode includes forming a plurality of trimming electrode so as to be electrically connected to each other.

4. The method according to claim 3, wherein the step of trimming includes the step of trimming the trimming electrodes one by one starting with the trimming electrode located on one end of the substrate.

5. The method according to claim 3, wherein the step of trimming includes trimming the plurality of electrodes in a stepwise manner without changing the value of inductance between the terminal electrodes.

6. The method according to claim 1, wherein the step of forming the first, second and third terminal electrodes is done via one of a thin-film forming process and a thick-film forming process.

7. The method according to claim 1, wherein the step of trimming is performed by one of a sandblasting process and a laser beam cutting process.

8. The method according to claim 1, further including the steps of forming a plurality of trimming electrodes, and forming a center tap electrode electrically connected to said third terminal electrode so as to be arranged between the outer portion of said first spiral coil electrode and the outer portion of said second spiral coil electrode, said plurality of trimming electrodes being electrically connected to said center tap electrode.

9. The method according to claim 3, wherein a second end of the first spiral coil electrode and a second end of the second spiral coil electrode are located on the outer side of the respective first and second spiral coil electrodes.

10. The method according to claim 3, wherein the second ends of the first and second spiral coil electrode are arranged to be substantially parallel to each other.

11. The method according to claim 3, wherein the trimming electrodes are formed in a ladder arrangement between the ends of the spiral coil electrodes.

* * * * *